United States Patent [19]

Mammino et al.

[11] 4,233,387

[45] Nov. 11, 1980

[54] ELECTROPHOTOGRAPHIC CARRIER POWDER COATED BY RESIN DRY-MIXING PROCESS

[75] Inventors: Joseph Mammino, Penfield; Timothy F. Johnson; David W. Walters, both of Williamson; Steven R. Perez, Pittsford, all of N.Y.

[73] Assignee: Xerox Corporation, Stamford, Conn.

[21] Appl. No.: 17,229

[22] Filed: Mar. 5, 1979

[51] Int. Cl.[3] ..... G03G 9/10; B05D 7/00

[52] U.S. Cl. ..... 430/137; 430/108; 427/216; 427/220; 427/221; 428/403

[58] Field of Search ..... 427/216, 220, 221; 252/62.1 P, 62.1 M; 430/137, 108

[56] References Cited

U.S. PATENT DOCUMENTS

| | | | |
|---|---|---|---|
| 3,196,032 | 7/1965 | Seymour | 252/62.1 P X |
| 3,895,125 | 7/1975 | Tsuchiya et al. | 252/62.1 P X |
| 3,922,382 | 11/1975 | Kukla et al. | 427/221 X |

*Primary Examiner*—John D. Welsh

[57] ABSTRACT

Electrostatographic coated carrier particles for use in the development of electrostatic latent images are provided by mixing carrier core materials with powdered thermoplastic resin particles having a size of between 0.1 micron and about 30 microns. The carrier core materials are mixed with the resin particles until the resin particles mechanically and/or electrostatically adhere to the core materials and the mixture is heated to a temperature of between 320° F. and 650° F. for between 120 minutes and 20 minutes so that the resin particles melt and fuse to the carrier core materials. The coated carrier particles are cooled, classified to the desired particle size, and mixed with finely-divided toner particles to form a developer mixture. The process is especially advantageous for coating carrier particles with resin materials having poor solubility characteristics.

14 Claims, No Drawings

ELECTROPHOTOGRAPHIC CARRIER POWDER COATED BY RESIN DRY-MIXING PROCESS

This invention is generally concerned with electrostatographic imaging systems and more specifically to improved carrier compositions having specific coatings which are useful in the development of electrophotographic images. It is well known to form and develop images on the surface of photoconductive materials by electrostatic methods such as described, for example, in U.S. Pat. Nos. 2,297,691; 2,277,013; 2,551,582; 3,220,324; and 3,220,833. In summary, these processes as described in the aforementioned patents involve the formation of an electrostatic latent charged image on an insulating electrophotographic element and rendering the latent image visible by a development step whereby the charged surface of the photoconductive element is brought into contact with a developer mixture. As described in U.S. Pat. No. 2,297,691, for example, the resulting electrostatic latent image is developed by depositing thereon a finely-divided electroscopic material referred to in the art as toner, the toner being generally attracted to the areas of the layer which retain a charge thus forming a toner image corresponding to the electrostatic latent image. Subsequently, the toner image can be transferred to a support surface such as paper and this transferred image can be permanently affixed to the support surface using a variety of techniques including pressure fixing, heat fixing, solvent fixing, and the like.

Many methods are known for applying the electroscopic particles to the latent image including cascade development, touchdown and magnetic brush as illustrated in U.S. Pat. Nos. 2,618,552; 2,895,847 and 3,245,823. One of the most widely used methods is cascade development wherein the developer material comprising relatively large carrier particles having finely-divided toner particles electrostatically clinging to the surface of the carrier particles is conveyed to and rolled or cascaded across the the electrostatic latent image-bearing surface. Magnetic brush development is also known and involves the use of a developer material comprising toner and magnetic carrier particles which are carried by a magnet so that the magnetic field produced by the magnet causes alignment of the magnetic carriers in a brush-like configuration. Subsequently, this brush is brought into contact with the electrostatic latent image-bearing surface causing the toner particles to be attracted from the brush to the electrostatic latent image by electrostatic attraction, as more specifically disclosed in U.S. Pat. No. 2,874,063.

Carrier materials used in the development of electrostatic latent images are described in many patents including, for example, U.S. Pat. No. 3,590,000. The type of carrier material to be used depends on many factors such as the type of development used, the quality of the development desired, the type of photoconductive material employed and the like. Generally, however, the materials used as carrier surfaces or carrier particles or the coating thereon should have a triboelectric value commensurate with the triboelectric value of the toner in order to generate electrostatic adhesion of the toner to the carrier. Carriers should be selected that are not brittle so as to cause flaking of the surfaces or particle break-up under the forces exerted on the carrier during recycle as such causes undesirable effects and could, for example, be transferred to the copy surface thereby reducing the quality of the final image.

There have been recent efforts to develop carriers and particularly coatings for carrier particles in order to obtain better development quality and also to obtain a material that can be recycled and does not cause any adverse effects to the photoconductor. Some of the coatings commercially utilized deteriorate rapidly especially when employed in a continuous process whereby the entire coating may separate from the carrier core in the form of chips or flakes as a result of poorly adhering coating material and fail upon impact and abrasive contact with machine parts and other carrier particles. Such carrier particles generally cannot be reclaimed and reused and usually provide poor print quality results. Further, the triboelectric values of some carrier coatings have been found to fluctuate when changes in relative humidity occur and thus these carriers are not desirable for use in electrostatographic systems as they can adversely affect the quality of the developed image.

In particular reproduction systems, in order to develop a latent image comprised of negative electrostatic charges, an electrostatic carrier and powder combination is selected in which the powder is triboelectrically charged positively relative to the granular carrier. Likewise, in order to develop a latent image comprised of positive electrostatic charges such as where a selenium photoreceptor is employed, an electroscopic powder and carrier mixture is selected in which the powder is triboelectrically charged negatively relative to the carrier. Thus, where the latent image is formed of negative electrostatic charges such when employing organic electrophotosensitive material as the photoreceptor, it is desirable to develop the latent image with a positively charged electroscopic powder and a negatively charged carrier material.

SUMMARY OF THE INVENTION

It is therefore an object of this invention to provide developer materials which overcome the above-noted deficiencies.

It is another object of this invention to provide carrier materials having coatings thereon which coatings have excellent adherence to the carrier core.

It is a further object of this invention to provide carrier coatings which are resistant to cracking, chipping, flaking, toner impaction, and which induce a positive charge on the toner material because of the triboelectric relationship between the carrier and toner compositions.

Another object of this invention is to provide coated carrier materials having controllable triboelectric and conductive characteristics, greatly increased useful life, and better flowability properties.

A further object of this invention is to provide improved developer materials, especially improved coated carrier materials, which may be used in electrostatographic development environments where the photoreceptor is negatively charged.

The above and other objects are accomplished by providing coated carrier particles for electrostatographic developer mixtures comprising finely-divided toner particles electrostatically clinging to the surface of the carrier particles. More specifically, the coated carrier particles of this invention are provided by mixing carrier core particles having an average diameter of from between about 30 microns and about 1,000 microns with from between about 0.05 percent and about 3.0 percent by weight, based on the weight of the coated carrier particles, of thermoplastic resin particles having a particle size of between about 0.1 micron and about 30 microns. The foregoing mixture is dry-mixed until the thermoplastic resin particles adhere to the carrier core particles by mechanical impaction and/or electrostatic attraction. The dry mixture is then heated to a temperature of between about 320° F. and about 650° F. for between about 120 minutes and about 20 minutes so that the thermoplastic resin particles melt and fuse to the carrier core particles. After fusion of the resin particles to the carrier core particles, the coated carrier particles are cooled and classified to the desired particle size. The resultant coated carrier particles have a fused resin coating over between about 15 percent and up to about 85 percent of their surface area.

With respect to the amount of thermoplastic resin particles employed, it is preferred that from between about 0.1 percent and about 1.0 percent by weight, based on the weight of the carrier core particles, of the resin particles be mixed with the carrier core particles. In this embodiment, it is preferred that the thermoplastic resin particles have a particle size of between about 0.5 micron and about 10 microns. Likewise, following dry-mixture of these resin particles and the carrier core particles, the mixture is preferably heated to a temperature of between about 400° F. and about 550° F. for between about 90 minutes and about 30 minutes. In this embodiment, the resultant coated carrier particles have a fused resin coating over between about 40 percent and about 60 percent of their surface area. Optimum results have been obtained when the amount of thermoplastic resin particles employed is from between about 0.1 percent and about 0.3 percent by weight, based on the weight of the carrier core particles. In this embodiment, the optimum particle size of the thermoplastic resin particles is between 0.5 micron and 1 micron. Further, the dry mixture is heated to a temperature of between about 480° F. and about 520° F. for between about 70 minutes and about 50 minutes. The resultant carrier particles have a fused resin coating over approximately 50 percent of their surface area.

Any suitable solid material may be employed as the carrier core in this invention. However, it is preferred that the carrier core material be selected so that the coated core material acquire a charge having a polarity opposite to that of the toner particles when brought into close contact therewith so that the toner particles adhere to and surround the carrier particles. In employing the carrier particles of this invention, it is also preferred that the carrier particles be selected so that the toner particles acquire a positive charge and the carrier particles acquire a negative triboelectric charge. Thus, by proper selection of the developer materials in accordance with their triboelectric properties, the polarities of their charge when mixed are such that the electroscopic toner particles adhere to and are coated on the surface of the carrier particles and also adhere to that portion of the electrostatic image-bearing surface having a greater attraction for the toner than the carrier particles.

In accordance with this invention, it is preferred that the carrier core material comprise low density, porous, magnetic or magnetically-attractable metal particles having a gritty, oxidized surface and a high surface area, i.e., a surface area which is at least about 200 $cm^2$/gram and up to about 1300 $cm^2$/gram of carrier material. Typical satisfactory carrier core materials include iron, steel, ferrite, magnetite, nickel and mixtures thereof. For ultimate use in an electrostatographic magnetic brush development system, it is preferred that the carrier core materials have an average particle size of between about 30 microns and about 200 microns. Excellent results have been obtained when the carrier core materials comprise porous, sponge iron or steel grit. The carrier core materials are generally produced by gas or water atomization processes or by reduction of suitable sized ore to yield sponge powder particles. The powders produced have a gritty surface, are porous, and have high surface areas. By comparison, conventional carrier core materials usually have a high density and smooth surface characteristics.

It has been found that when attempts are made to apply an insulating resin coating to porous, metallic carrier core materials by solution-coating techniques that the products obtained are undesirable. This is so because most of the coating material is found to reside in the pores of carrier cores and not at the surface thereof so as to be available for triboelectric charging when the coated carrier particles are mixed with finely-divided toner particles. Attempts to resolve this problem by increasing carrier coating weights, for example, to as much as up to about 3 percent or greater to provide an effective triboelectric charging coating to the carrier particles necessarily involves handling excessive quantities of solvents and usually results in low product yields. It has also been found that toner impaction, i.e., where toner particles become welded to or impacted upon the carrier particles, remains high with thus coated carrier particles producing short developer useful lifetimes. Further, solution-coated porous carrier particles when combined and mixed with finely-divided toner particles provide triboelectric charging levels which are too low for practical use. In addition, solution-coated carrier particles have a high incidence of electrical breakdown at low applied voltages leading to shorting between the carrier particles and the photoreceptor. Thus, the powder coating technique of this invention has been found to be especially effective in coating porous carrier cores to obtain coated carrier particles capable of generating high and useful triboelectric charging values to finely-divided toner particles and carrier particles which possess significantly increased resistivities. In addition, when resin coated carrier particles are prepared by the powder coating technique of this invention, the majority of the coating material particles are fused to the carrier surface and thereby reduce the number of potential toner impaction sites on the carrier material.

The dry, powdered thermoplastic resin particles employed in this invention may be any suitable insulating coating material. Typical insulating coating materials include vinyl chloride-vinyl acetate copolymers, styrene-acrylate-organosilicon terpolymers, natural resins such as caoutchouc, carnauba, colophony, copal, dammar, jalap, storax; thermoplastic resins including the polyolefins such as polyethylene, polypropylene, chlorinated polyethylene, chlorosulfonated polyethylene, and copolymers and mixtures thereof; polyvinyls and polyvinylidenes such as polystyrene, polymethyl-styrene, polymethyl methacrylate, polyacrylonitrile, polyvinyl acetate, polyvinyl alcohol, polyvinyl butyral, polyvinyl chloride, polyvinyl pyridine, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as polycaprolactam and polyhexamethylene adipamide; polyesters such as polyethylene terephthalate; polyurethanes; polysulfides, polycarbonates, thermosetting resins including phenolic resins such as phenol-formaldehyde, phenol-furfural and resorcinol formaldehyde; amino resins such as urea-formaldehyde and melamine-formaldehyde; polyester resins; epoxy resins; and the like. Many of the foregoing and other typical carrier coating materials are described by L. E. Walkup in U.S. Pat. No. 2,618,551; B. B. Jacknow et al in U.S. Pat. No. 3,526,433; and R. J. Hagenbach et al in U.S. Pat. Nos. 3,533,835 and 3,658,500. However, it is preferred that the coating material be of the type capable of providing negative triboelectric charging values to the carrier particles wherein the toner particles obtain a positive triboelectric charge for attraction of the toner particles to a negatively charged photoconductive surface. Such carrier coating materials include thermoplastic resins which have been rendered into powder particle form having a particle size of between about 1 and about 100 microns. The preferred powdered coating materials of this invention are selected from fluorinated ethylene, fluorinated propylene and copolymers, mixtures, combinations or derivatives thereof such as fluorinated ethylene-propylene commercially available from E. I. Dupont Co., Wilmington, Del., under the tradename FEP; trichlorofluoroethylene, perfluoroalkoxy tetrafluoroethylene, the zinc and sodium salts of ionomer resins such as those containing carboxyl groups which are ionically bonded by partial neutralization with strong bases such as sodium hydroxide and zinc hydroxide to create ionic crosslinks in the intermolecular structure thereof, and polyvinylidene fluoride and the like. It is also preferred that the powdered coating materials of this invention comprise those which have been prepared by emulsion polymerization techniques because they are available in smaller particle size than those prepared by other polymerization techniques. It is to be noted that most fluoropolymers are not soluble in common solvents; thus, the powder coating technique of this invention is especially advantageous when preparing fluoropolymer coated carrier materials for use in electrostatographic devices.

In the initial step of the preparation process of this invention, any suitable means may be employed to apply the coating material powder particles to the surface of the carrier core material. Typical means for this purpose include combining the carrier core material and coating material particles mixture by cascade roll-milling or tumbling, milling, shaking, electrostatic powder cloud spraying, employing a fluidized bed, electrostatic disc processing, and an electrostatic curtain. Following application of the coating material powder particles to the carrier core material, the coated carrier material is heated to permit flow-out of the coating material powder particles over the surface of the carrier core material. As will be appreciated, the concentration of coating material powder particles as well as the conditions of the heating step may be selected as to form a continuous film of the coating material on the surface of the carrier core material or leave selected areas of it uncoated. Where selected areas of the carrier core material remain uncoated or exposed, the carrier material will possess electrically conductive properties when the core material comprises a metal. Thus, when such partially polymer coated carrier materials are provided, these carrier materials possess both electrically insulating and electrically conductive properties. Due to the electrically insulating properties of these carrier materials, the carrier materials provide desirably high triboelectric charging values when mixed with finely-divided toner particles.

Any suitable finely-divided toner material may be employed with the carrier materials of this invention. Typical toner materials include, for example, gum copal, gum sandarac, rosin, asphaltum, phenol-formaldehyde resins, rosin-modified phenol-formaldehyde resins, methacrylate resins, polystyrene resins, polystyrene-butadiene resins, polyester resins, polyethylene resins, epoxy resins and copolymers and mixtures thereof. The particular type of toner material to be used depends to some extent upon the separation of the toner particles from the coated carrier particles in the triboelectric series. Patents describing typical electroscopic toner compositions include U.S. Pat. Nos. 2,659,670; 3,079,342; Re. 25,136 and 2,788,288. Generally, the toner materials have an average particle diameter of between about 5 and 15 microns. Preferred toner resins include those containing a high content of styrene because they generate high triboelectric charging values, and a greater degree of image definition is achieved when employed with the carrier materials of this invention. Generally speaking, satisfactory results are obtained when about 1 part by weight toner is used with about 10 to 200 parts by weight of carrier material.

Any suitable pigment or dye may be employed as the colorant for the toner particles. Toner colorants are well known and include, for example, carbon black, nigrosine dye, aniline blue, Calco Oil Blue, chrome yellow, ultramarine blue, duPont Oil Red, Quinoline Yellow, methylene blue chloride, phthalocyanine blue, Malachite Green Oxalate, lamp black, iron oxide, Rose Bengal and mixtures thereof. The pigment and/or dye should be present in the toner in a quantity sufficient to render it highly colored so that it will form a clearly visible image on a recording member. Thus, for example, where conventional xerographic copies of typed documents are desired, the toner may comprise a black pigment such as carbon black or a black dye such as Amaplast Black dye, available from National Aniline Products, Inc. Preferably, the pigment is employed in an amount from about 3 percent to about 20 percent by weight, based on the total weight of the colored toner. If the toner colorant employed is a dye, substantially smaller quantities of colorant may be used.

The developer compositions of the instant invention may be employed to develop electrostatic latent images on any suitable electrostatic latent image-bearing surface including conventional photoconductive surfaces. Well-known photoconductive materials include vitreous selenium, organic or inorganic photoconductors embedded in a non-photoconductive matrix, organic or inorganic photoconductors embedded in a photoconductive matrix, or the like. Representative patents in which photoconductive materials are disclosed include U.S. Pat. No. 2,803,542 to Ullrich; U.S. Pat. No. 2,970,906 to Bixby; U.S. Pat. No. 3,121,006 to Middleton; U.S. Pat. No. 3,121,007 to Middleton; and U.S. Pat. No. 3,151,982 to Corrsin.

In the following examples, the relative triboelectric values generated by contact of carrier particles with toner particles is measured by means of a Faraday Cage. The device comprises a steel cylinder having a diameter of about one inch and a length of about one inch. A 400-mesh screen is positioned at each end of the cylinder. The cylinder is weighed, charged with about 0.5 gram mixture of carrier and toner particles and connected to ground through a capacitor and an electrometer connected in parallel. Dry compressed air is then blown through the steel cylinder to drive all the toner from the carrier. The charge on the capacitor is then read on the electrometer. Next, the chamber is reweighed to determine the weight loss. The resulting data is used to calculate the toner concentration and the charge in microcoulombs per gram of toner. Since the triboelectric measurements are relative, the measurements should, for comparative purposes, be conducted under substantially identical conditions.

DESCRIPTION OF PREFERRED EMBODIMENTS

The following examples further define, describe and compare methods of preparing the carrier materials of the present invention and of utilizing them to develop electrostatic latent images. Parts and percentages are by weight unless otherwise indicated.

EXAMPLE I

A control carrier material was prepared comprising about 99 parts of atomized iron carrier cores (available from Hoeganaes Corporation, Riverton, N.J., under the tradename ANCOR STEEL 80/150) having an average particle diameter of about 150 microns. A coating composition comprising about 10 percent solids of polyvinyl chloride and trifluorochloroethylene prepared from a material commercially available as FPC 461 from Firestone Plastics Company, Pottstown, Pa., dissolved in methyl ethyl ketone is spray-dried onto the carrier cores as to provide them with a coating weight of about 1 percent.

About 97 parts by weight of the coated carrier particles was mixed with about 3 parts by weight of toner particles having an average diameter of about 12 microns. The composition of the toner particles comprised about 87 parts of a 65/35 styrene-n-butyl methacrylate copolymer, about 10 parts of carbon black and about 3 parts of nigrosine SSB. The mixture of carrier particles and toner particles was employed in a magnetic brush development testing fixture equipped with a photoreceptor charged to a negative polarity. The testing fixture was set as to provide a solid area density of about 1.3 to developed electrostatic latent images. It was found that this developer mixture was unsatisfactory in that the triboelectric charge generated on the toner material was about −11 microcoulombs per gram of toner, and the image background density was about 0.04 which is considerably above the acceptable level of 0.01.

EXAMPLE II

A control carrier material was prepared comprising about 97 parts of sponge iron carrier cores (available from Hoeganaes Corporation, Riverton, N.J., under the tradename ANCOR EH 80/150) having an average particle diameter of about 150 microns. A coating composition comprising about 10 percent solids of polyvinyl chloride and trifluorochloroethylene prepared from a material commercially available as FPC 461 from Firestone Plastics Company, Pottstown, Pa., dissolved in methyl ethyl ketone is applied to the carrier cores as to provide them with a coating weight of about 3 percent. The coating composition was applied to the carrier cores via solution coating employing a vibratub (available from Vibraslide, Inc., Binghamton, N.Y.)

About 97 parts by weight of the coated carrier particles was mixed with about 3 parts by weight of toner particles having an average diameter of about 12 microns. The composition of the toner particles comprised about 87 parts of a 65/35 styrene-n-butyl methacrylate copolymer, about 10 parts of carbon black and about 3 parts of nigrosine SSB. The mixture of carrier particles and toner particles was employed in a magnetic brush development testing fixture equipped with a photoreceptor charged to a negative polarity. The testing fixture was set as to provide a solid area density of about 1.3 to developed electrostatic latent images. It was found that this developer mixture was unsatisfactory in that the triboelectric charge generated on the toner material was about −14 microcoulombs per gram of toner, and the image background density was about 0.04 which is considerably above the acceptable level of 0.01.

EXAMPLE III

A carrier material was prepared comprising about 99 parts of sponge iron carrier cores as in Example II. The carrier cores were mixed for about 10 minutes with about 1.0 part of powdered polyvinyl chloride and trifluorochloroethylene prepared from a material commercially available as FPC 461 from Firestone Plastics Company, Pottstown, Pa. The powdered coating material was attrited to an average particle diameter of less than about 44 microns. The dry mixture was placed in a muffle furnace and heated to a maximum temperature of about 325° F. and cooled to room temperature over a total process time of about 75 minutes.

About 97 parts by weight of the coated carrier particles was mixed with about 3 parts by weight of toner particles as in Example I. The mixture of carrier and toner particles was employed as in Example I to develop an electrostatic latent image. It was found that this developer mixture was satisfactory in that the triboelectric charge generated on the toner material was higher than obtained with the developer mixtures of Examples I and II, the developed image background density was only about 0.006, and the image quality was excellent.

EXAMPLE IV

A carrier material was prepared comprising about 99.6 parts of the atomized iron carrier cores described in Example I. The carrier cores were mixed for about 10 minutes with about 0.4 parts of powdered perfluoroalkoxy tetrafluoroethylene having an average particle diameter of about 10 microns. The dry mixture was then heated to a temperature of about 650° F. and held at that temperature for about 20 minutes then rapidly cooled to room temperature by means of a fluidizing bath.

About 97 parts by weight of the coated carrier particles was mixed with about 3 parts by weight of toner particles. The composition of the toner particles comprised about 92 parts by weight of a 65/35 styrene-n-butyl methacrylate copolymer, 6 parts carbon black, and 2 parts of cetyl pyridinium chloride. The mixture of carrier and toner particles was employed as in Example I to develop an electrostatic latent image. It was found that this developer mixture was satisfactory in that the developed image background density was only about 0.004 and the image quality was excellent.

EXAMPLE V

A carrier material was prepared comprising about 99.8 parts of atomized iron carrier cores (available from Hoeganaes Corporation, Riverton, N.J., under the tradename ANCOR STEEL 80/150) having an average particle diameter of about 150 microns. The carrier cores were mixed for about 10 minutes with about 0.2 parts of powdered polyvinylidene fluoride (available from Pennwalt Corporation, King of Prussia, Pa., under the tradename Kynar 201) having an average particle diameter of about 0.35 micron. The dry mixture was then heated to a temperature of about 510° F. for about 60 minutes and cooled to room temperature.

About 97 parts of weight of the coated carrier particles was mixed with about 3 parts by weight of toner particles as in Example I. The mixture of carrier and toner particles was employed as in Example I to develop an electrostatic latent image. It was found that this developer mixture was satisfactory in that the developed image background density was only about 0.002 and the image quality was excellent after simulating the preparation of 300,000 copies therewith on an aging fixture. The triboelectric charge generated on the toner material was about −18 microcoulombs per gram of toner material.

EXAMPLE VI

A carrier material was prepared comprising about 99.8 parts of sponge iron carrier cores (available from Hoeganaes Corporation, Riverton, N.J., under the tradename ANCOR EH 80/150) having an average particle diameter of about 150 microns. The carrier cores were mixed for about 10 minutes with about 0.2 parts of powdered perfluoroalkoxy tetrafluoroethylene having an average particle diameter of about 10 microns. The dry mixture was then heated to a maximum temperature of about 650° F. and held at that temperature for about 20 minutes then rapidly cooled to room temperature by means of a fluidizing bath.

About 97 parts by weight of the coated carrier particles was mixed with about 3 parts by weight of toner particles as in Example I. The mixture of carrier and toner particles was employed as in Example I to develop an electrostatic latent image. It was found that this developer mixture was satisfactory in that the developed image background density was about 0.003 and the image quality was excellent. The triboelectric charge generated on the toner material was about −19 microcoulombs per gram of toner material.

EXAMPLE VII

A carrier material was prepared comprising about 99.85 parts of atomized iron carrier cores (available from Hoeganaes Corporation, Riverton, N.J., under the tradename ANCOR STEEL 80/150) having an average particle diameter of about 150 microns. The carrier cores were mixed for about 10 minutes with about 0.15 parts of powdered polyvinylidene fluoride (available from Pennwalt Corporation, King of Prussia, Pa., under the tradename Kynar 301F). The dry mixture was then heated to a maximum temperature of about 510° F. for about 60 minutes then rapidly cooled to room temperature by means of a fluidizing bath.

About 97 parts by weight of the coated carrier particles was mixed with about 3 parts by weight of toner particles as in Example I. The mixture of carrier and toner particles was employed as in Example I to develop an electrostatic latent image. It was found that this developer mixture was satisfactory in that the developed image background density was about 0.01 and the image quality was excellent. The triboelectric charge generated on the toner material was about −20 microcoulombs per gram of toner material.

EXAMPLE VIII

A carrier material was prepared comprising about 99.8 parts of atomized iron carrier cores (available from Hoeganaes Corporation, Riverton, N.J., under the tradename ANCOR STEEL 80/150) having an average particle diameter of about 150 microns. The carrier cores were mixed for about 10 minutes with about 0.2 parts of powdered polyethylene (available from USI Chemicals Corporation, New York, N.Y., under the tradename Microthene) having an average particle diameter of about 16 microns. The dry mixture was heated to a maximum temperature of about 325° F. and allowed to cool to room temperature during a total process time of about 30 minutes.

About 97 parts by weight of the coated carrier particles was mixed with about 3 parts by weight of toner particles as in Example I. The mixture of carrier and toner particles was employed as in Example I to develop an electrostatic latent image. It was found that this developer mixture was satisfactory in that the developed image background density was only about 0.005 and the image quality was excellent.

EXAMPLE IX

A carrier material was prepared comprising about 99.8 parts of atomized iron carrier cores (available from Hoeganaes Corporation, Riverton, N.J., under the tradename ANCOR STEEL 80/150) having an average particle diameter of about 150 microns. The carrier cores were mixed for about 10 minutes with about 0.2 parts of powdered polyvinylidene fluoride as described in Example V. The dry mixture was then heated to a temperature of about 510° F. for about 60 minutes and cooled to room temperature.

About 97 parts by weight of the coated carrier particles was mixed with about 3 parts by weight of toner particles having an average diameter of about 12 microns. The composition of the toner particles comprised about 92 parts of a 65/35 styrene-n-butyl methacrylate copolymer, about 6 parts of carbon black, and about 2 parts of cetyl pyridinium chloride. The mixture of carrier particles and toner particles was employed as in Example I to develop an electrostatic latent image. It was found that this developer mixture was satisfactory in that the developed image background density was only 0.005 and the image quality was excellent. The triboelectric charge generated on the toner material was about −24 microcoulombs per gram of toner material.

EXAMPLE X

A carrier material was prepared comprising about 99.7 parts of sponge iron carrier cores as described in Example II. The carrier cores were mixed for about 10 minutes with about 0.3 parts of powdered fluorinated ethylene-propylene (available from E. I. duPont Co., Wilmington, Del., under the tradename Teflon FEP) having an average particle diameter of about 5 microns. The dry mixture was then heated to a temperature of about 600° F. for about 30 minutes and rapidly cooled to room temperature by means of a fluid bath.

About 97 parts by weight of the coated carrier particles was mixed with about 3 parts by weight of toner particles. The composition of the toner particles comprised about 89 parts by weight of 65/35 styrene-n-butyl methacrylate copolymer, about 1 part of distearyl dimethyl ammonium chloride (available from Ashland Oil Co., Ashland, Ky., under the tradename ARO-SURF), and about 10 parts of carbon black. The mixture of carrier and toner particles was employed as in Example I to develop an electrostatic latent image. It was found that this developer mixture was satisfactory in that the developed image background density was about 0.009 and the image quality was excellent. The triboelectric charge generated on the toner material was about −19 microcoulombs per gram of toner material.

Although specific materials and conditions are set forth in the foregoing examples, these are merely intended as illustrations of the present invention. Various other suitable thermoplastic toner resin components, additives, colorants, and development processes such as those listed above may be substituted for those in the examples with similar results. Other materials may also be added to the toner or carrier to sensitize, synergize or otherwise improve the fusing properties or other desirable properties of the system.

Other modifications of the present invention will occur to those skilled in the art upon a reading of the present disclosure. These are intended to be included within the scope of this invention.

What is claimed is:

1. The process of preparing coated carrier particles useful in electrostatographic developer mixtures for the development of electrostatic latent images, said process comprising the steps of mixing low density, porous, magnetic or magnetically-attractable metal carrier core particles having a gritty, oxidized surface and a surface area of at least about 200 $cm^2$/gram and up to about 1300 $cm^2$/gram of said carrier particles with from between about 0.05 percent and about 3.0 percent by weight based on the weight of the coated carrier particles, of particulate thermoplastic resin material having a particle size of between about 0.1 micron and about 30 microns, dry-mixing said carrier core particles and said thermoplastic resin material until said thermoplastic resin material adheres to said carrier core particles by mechanical impaction or electrostatic attraction, heating the mixture of carrier core particles and thermoplastic resin material to a temperature of between about 320° F. and about 650° F. for between about 120 minutes and about 20 minutes so that said thermoplastic resin material melts and fuses to said carrier core particles, cooling the coated carrier particles, and classifying said coated carrier particles to the desired particle size.

2. The process of preparing coated carrier particles in accordance with claim 1 wherein said carrier particles are provided with a fused coating of said thermoplastic resin material over between about 15 percent and about 85 percent of their surface area.

3. The process of preparing coated carrier particles in accordance with claim 1 wherein said carrier core particles are mixed with from about 0.1 percent and about 1.0 percent by weight, based on the weight of said carrier core particles, of said thermoplastic resin material.

4. The process of preparing coated carrier particles in accordance with claim 3 wherein said thermoplastic resin material has a particle size of between about 0.5 micron and about 10 microns.

5. The process of preparing coated carrier particles in accordance with claim 4 wherein said mixture of carrier core particles and thermoplastic resin material is heated to a temperature of between about 400° F. and 550° F. for between about 90 minutes and about 30 minutes.

6. The process of preparing coated carrier particles in accordance with claim 5 wherein said carrier particles are provided with a fused coating of said thermoplastic resin material over between about 40 percent and about 60 percent of their surface area.

7. The process of preparing coated carrier particles in accordance with claim 1 wherein said carrier core particles are mixed with from about 0.1 percent and about 0.3 percent by weight, based on the weight of said carrier core particles, of said thermoplastic resin material.

8. The process of preparing coated carrier particles in accordance with claim 7 wherein said thermoplastic resin material has a particle size of between about 0.5 micron and about 1 micron.

9. The process of preparing coated carrier particles in accordance with claim 8 wherein said mixture of carrier core particles and thermoplastic resin material is heated to a temperature of between about 480° F. and 520° F. for between about 70 minutes and about 50 minutes.

10. The process of preparing coated carrier particles in accordance with claim 9 wherein said carrier particles are provided with a fused coating of said thermoplastic resin material over about 50 percent of their surface area.

11. The process of preparing coated carrier particles in accordance with claim 1 wherein said carrier particles have an average diameter of from between about 30 microns and about 1,000 microns.

12. The process of preparing coated carrier particles in accordance with claim 1 wherein said carrier core particles are selected from the group consisting of iron, steel, ferrite, magnetite, nickel, and mixtures thereon.

13. The process of preparing coated carrier particles in accordance with claim 1 wherein said carrier core particles have an average particle diameter of between about 30 microns and about 200 microns.

14. The process of preparing coated carrier particles in accordance with claim 1 wherein said thermoplastic resin material is selected from the group consisting of fluorinated ethylene, fluorinated propylene, fluorinated ethylenepropylene, trichlorofluoroethylene, perfluoroalkoxy tetrafluoroethylene, polyvinylidene fluoride, polyvinyl chloride, trifluorochloroethylene, and derivatives thereof.

* * * * *